US008052299B2

(12) United States Patent
Lin

(10) Patent No.: US 8,052,299 B2
(45) Date of Patent: Nov. 8, 2011

(54) LIGHT SOURCE MODULE AND LIGHT SOURCE MODULE ARRAY HAVING SAME

(75) Inventor: Hou-Yao Lin, Taipei Hsien (TW)
(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 332 days.
(21) Appl. No.: 12/503,973
(22) Filed: Jul. 16, 2009
(65) Prior Publication Data

US 2010/0142203 A1 Jun. 10, 2010

(30) Foreign Application Priority Data

Dec. 5, 2008 (CN) ..... 2008 1 0305993.8

(51) Int. Cl.
*F21S 4/00* (2006.01)
(52) U.S. Cl. ..... 362/219; 362/217.16; 362/217.17; 362/253; 362/249.01; 362/430; 446/124; 446/484; 446/485
(58) Field of Classification Search ..... 362/217.12–217.13, 217.16, 217.17, 219, 225, 249.01, 362/249.14, 253, 382, 418, 430; 446/85, 446/91, 124–125, 128, 484–485
See application file for complete search history.

(56) References Cited

U.S. PATENT DOCUMENTS 4,883,440 A * 11/1989 Bolli ..... 446/91
6,805,605 B2 * 10/2004 Reining et al. ..... 446/91
2011/0031689 A1 * 2/2011 Binder ..... 273/157 R
* cited by examiner

*Primary Examiner* — Stephen F Husar
*Assistant Examiner* — Meghan Dunwiddie
(74) *Attorney, Agent, or Firm* — Altis Law Group, Inc.

(57) ABSTRACT

A light source module includes a base, a supporter, and a light source fixed by the supporter. The base includes a top surface, a first side surface connected with the top surface, a second side surface connected with the top surface, a protrusion projecting from the first side surface, and a recess defined in the second side surface. The protrusion is for inserting into a recess of another light source module. The recess is configured for coupling with a protrusion of still another light source module. The supporter is mounted on the top surface of the base.

18 Claims, 8 Drawing Sheets

LIGHT SOURCE MODULE AND LIGHT SOURCE MODULE ARRAY HAVING SAME

BACKGROUND

1. Technical Field

The present disclosure relates to a light source module and a light source module array having the light source module.

2. Description of Related Art

Light source modules, such as incandescence lamps, fluorescent lamps and halogen lamps, generally have a limited illumination area. However, it is not adequate to use these light source modules in certain areas, such as stadiums and stages, where a large-area illumination is needed.

In order to illuminate a large area, a plurality of light source modules can be used simultaneously, each of which works independently. However, since the light source modules are arranged independently, it can be difficult and troublesome to install.

Therefore, a new light source module and a new light source module array are desired to overcome the above mentioned problems.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Embodiments will now be described in detail below with reference to the drawings.

Figure 1:
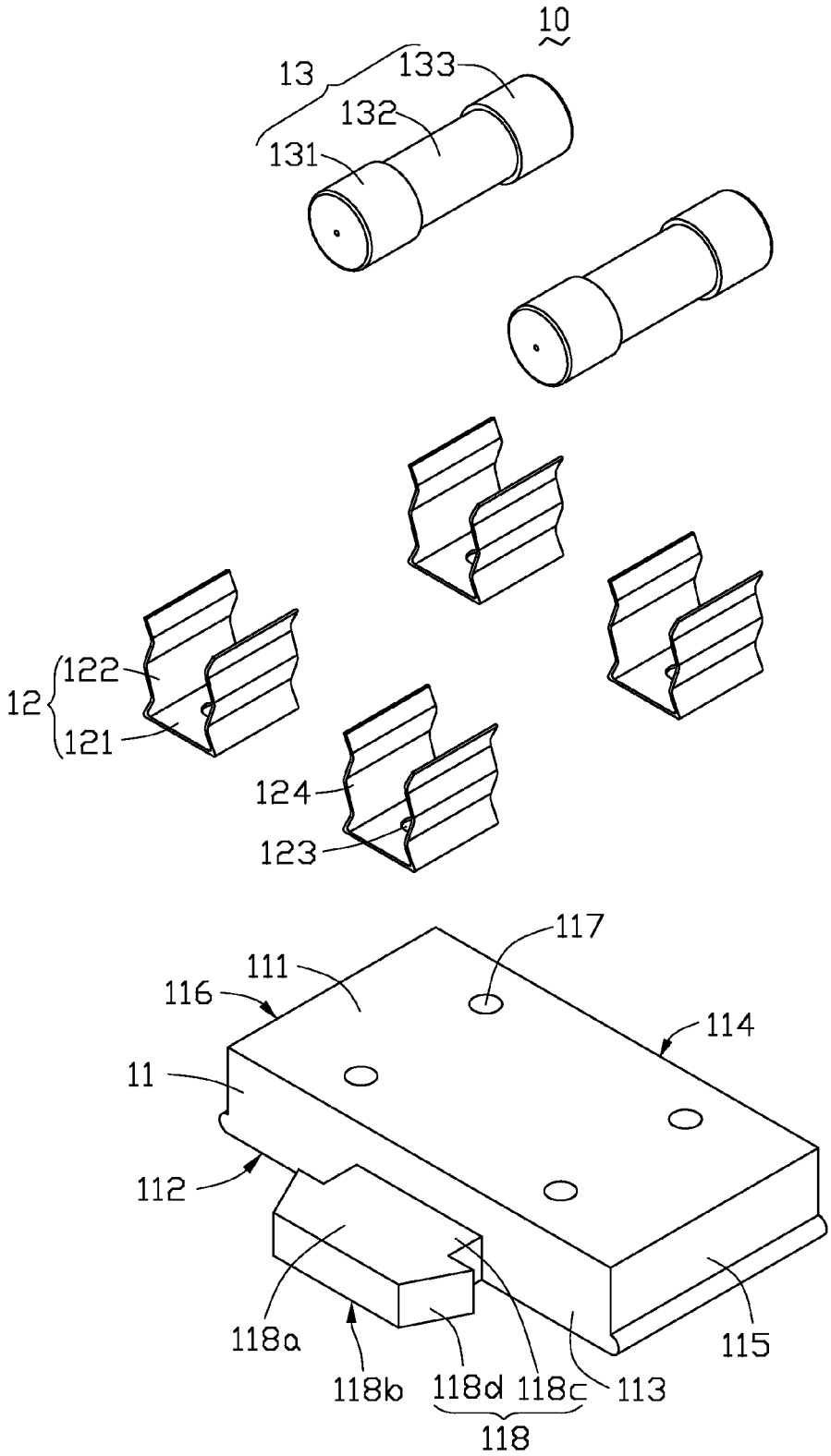
FIG. 1 is an exploded perspective view of a light source module according to a first embodiment of the present invention.
Figure 2:
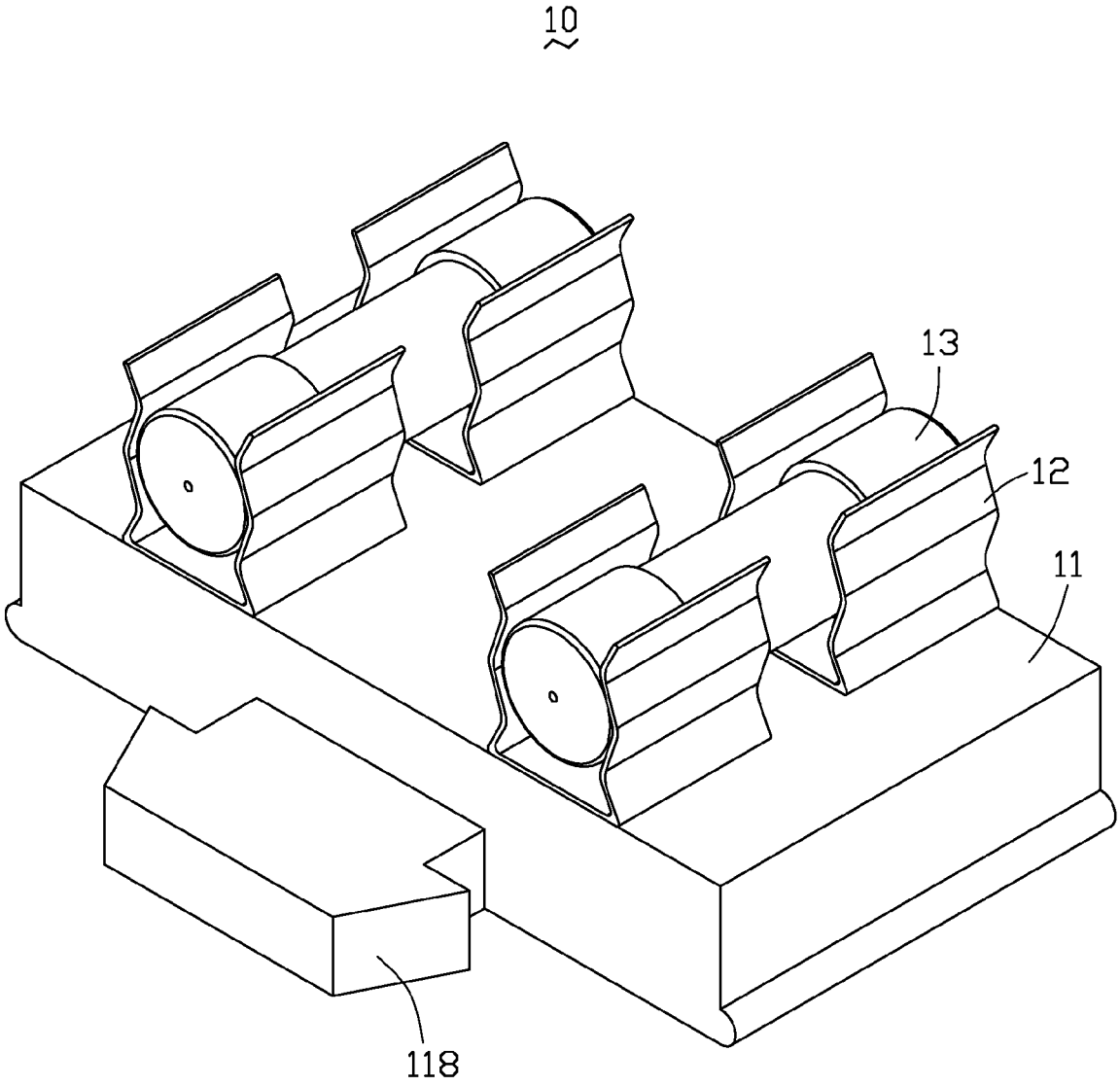
FIG. 2 is a perspective view of the light source module of FIG. 1.
Figure 3:
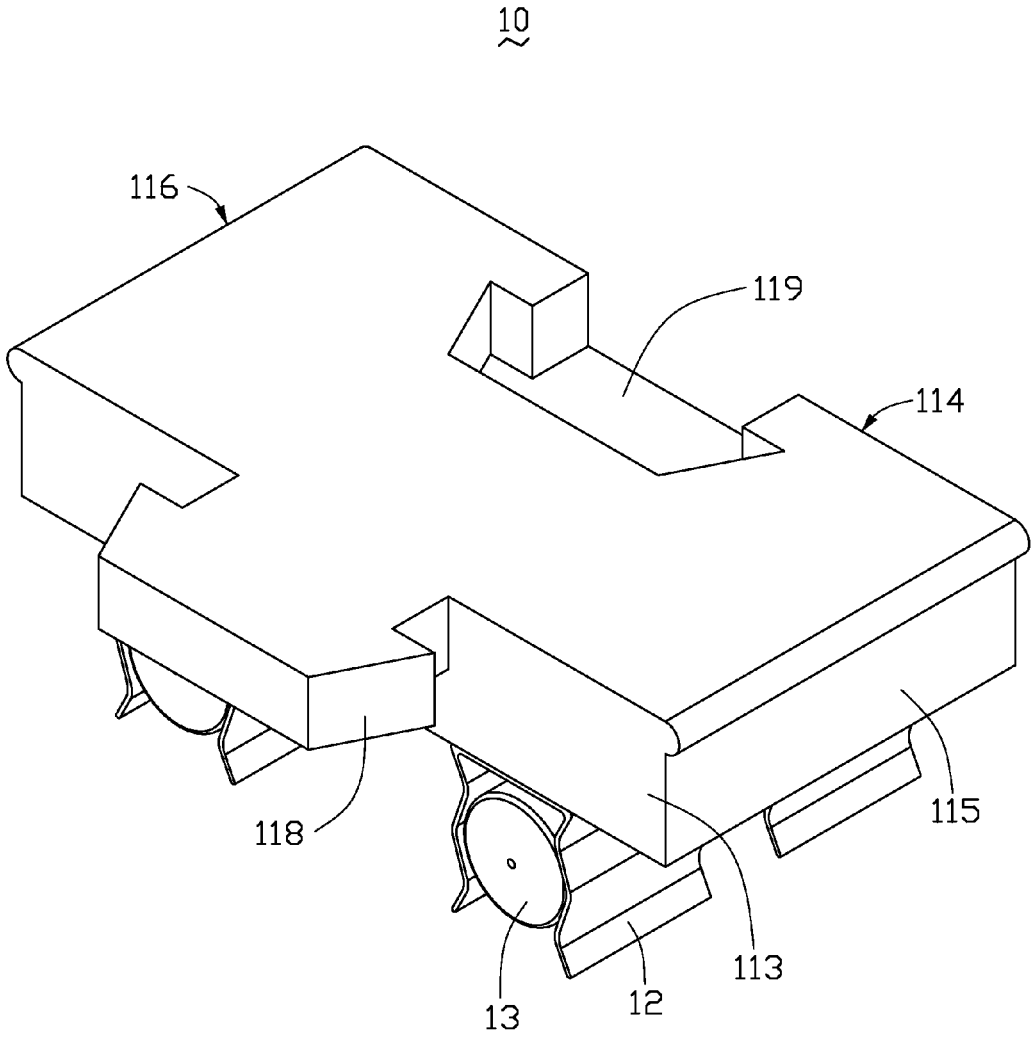
FIG. 3 is another perspective view of the light source module of FIG. 1.

Referring to FIGS. 1-3, a light source module 10 according to a first embodiment is shown. The light source module 10 includes a base 11, four supporters 12, and two light sources 13.

The base 11 is rectangular and includes a first top surface 111, a first bottom surface 112, a first side surface 113, a second side surface 114, a third surface 115 and a fourth surface 116. The first bottom surface 112 is opposite to the first top surface 111. The first top surface 111 includes four screw holes 117 defined therein.

The base 11 further includes a protrusion 118 and a recess 119. The protrusion 118 projects from the first side surface 113. The protrusion 118 includes a second top surface 118*a* and a second bottom surface 118*b*. The second top surface 118*a* is parallel with the first top surface 111, and the second bottom surface 118*b* is coplanar with the first bottom surface 112. A thickness of the protrusion 118 is less than that of the base 11, and accordingly, the second top surface 118*a* is between the first top surface 111 and the first bottom surface 112. The protrusion 118 can be rectangular, triangular, etc. In the present embodiment, the protrusion 118 is substantially arrow-shaped. The protrusion 118 includes a first part 118*c* and a second part 118*d*. The first part 118*c* is connected with the first side surface 113, and has a rectangular cross section. The second part 118*d* is connected with the first part 118*c*, and has a trapeziform cross section. The recess 119 is defined in the second side surface 114. A shape of the recess is corresponding to shape of the protrusion 118.

The supporters 12 are fastened to the first top surface 111 of the base 11, and configured for fixing light sources 13. Each supporter 12 includes a pair of fixing parts 122 and a connecting part 121 connected between fixing parts 122. The connecting part 121 includes a screw hole 123 therein. The screw hole 123, 117 can be coupled to each other via screws (not shown) so that the supporters 12 are fastened to the base 11. Each fixing part 122 is wave-shaped (i.e., zigzag) in cross-section. Each pair of fixing part 122 cooperatively defines a receiving space 124 therebetween, and is configured for cooperatively clamping the light source 13.

Each light source 13 is a cylindrical light emitting diode (LED). Each light source 13 includes a first end portion 131, a light emitting portion 132, and a second end portion 133. In the present embodiment, each light source 13 is clamped by two supporters in such a manner that a first end portion 131 is clamped by a supporter 12, and a second end portion 133 is clamped by another supporter 12.

Figure 4:
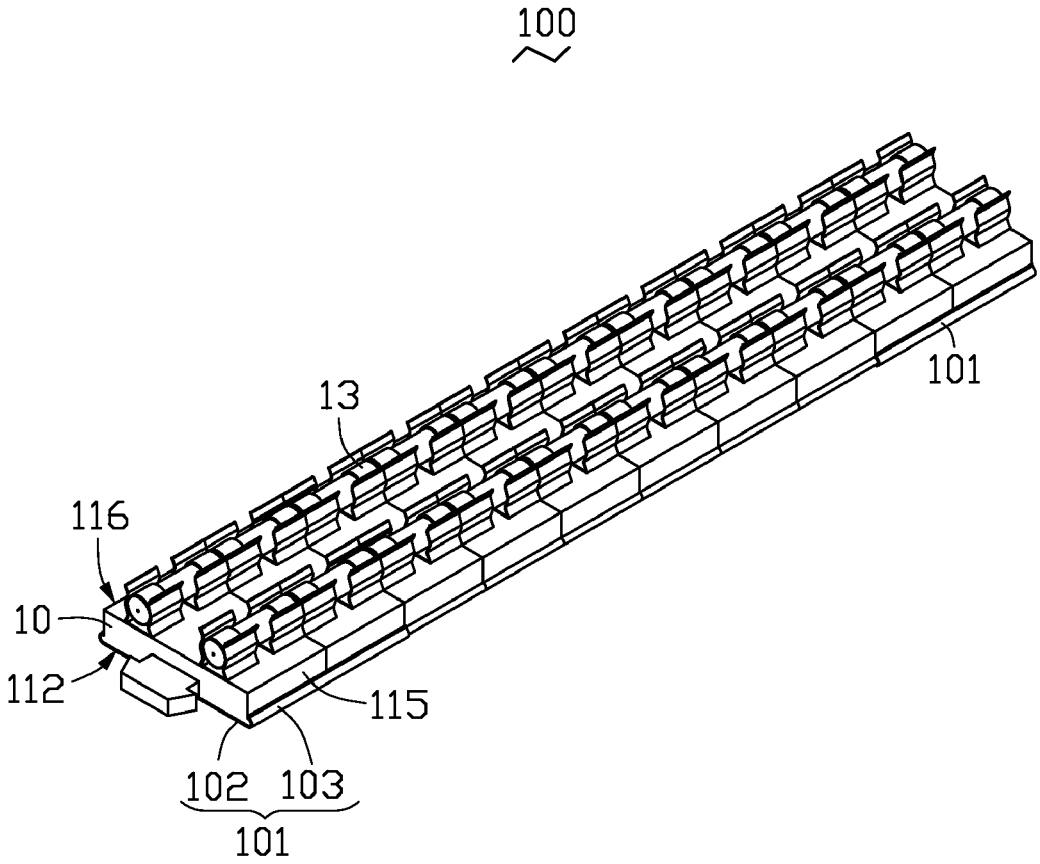
FIG. 4 is a perspective view of a light source module array according to a second embodiment of the present invention, having a plurality of light source modules of FIG. 1.
Figure 5:
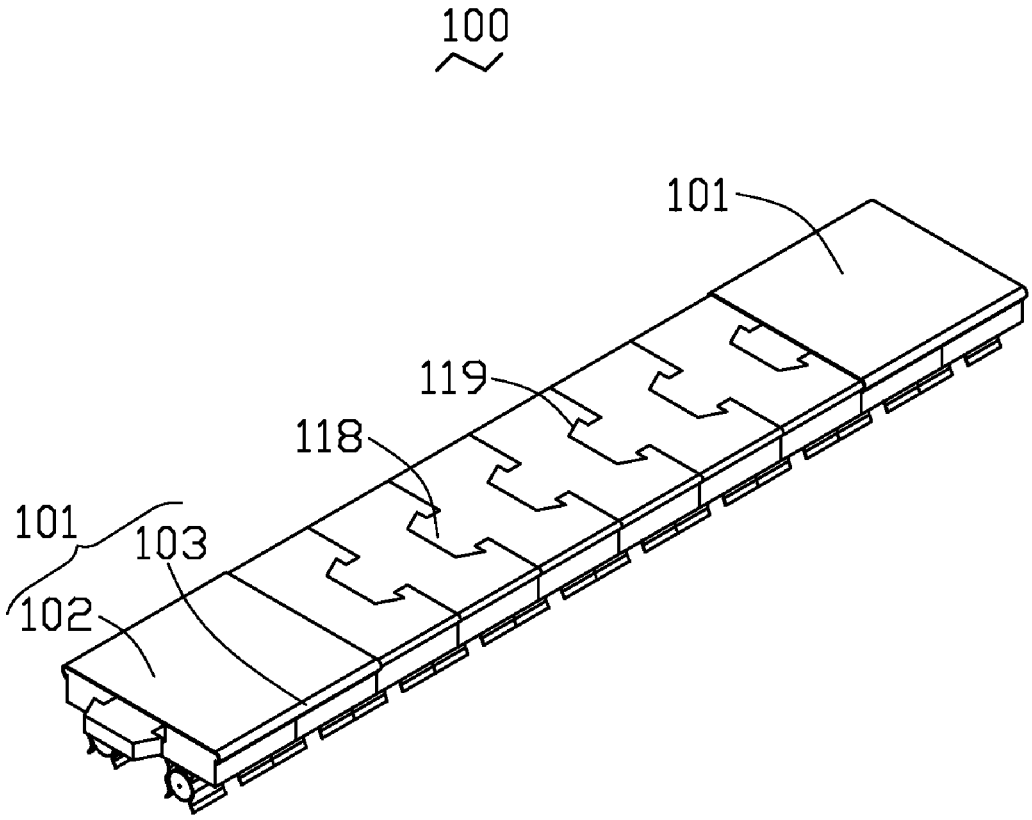
FIG. 5 is another perspective view of the light source module array of FIG. 4.

Referring to FIGS. 4-5, a light source module array 100 according to a second embodiment is shown. The light source module array 100 includes a plurality of light source module 10 of the first embodiment, as shown in FIGS. 1-3.

A protrusion 118 of a light source module 10 is inserted in a recess 119 of an adjacent light source module 10. The light source module array 100 further includes two fastening members 101 arranged on two ends thereof. Each fastening member 101 includes a bottom wall 102 and two side walls 103 extending from the bottom wall 102. The bottom wall 102 is in contact with the first bottom surface 112 of the base 11, and the side walls 103 are in contact with the third surface 115 and the fourth surface 116 of the base 11.

Figure 6:
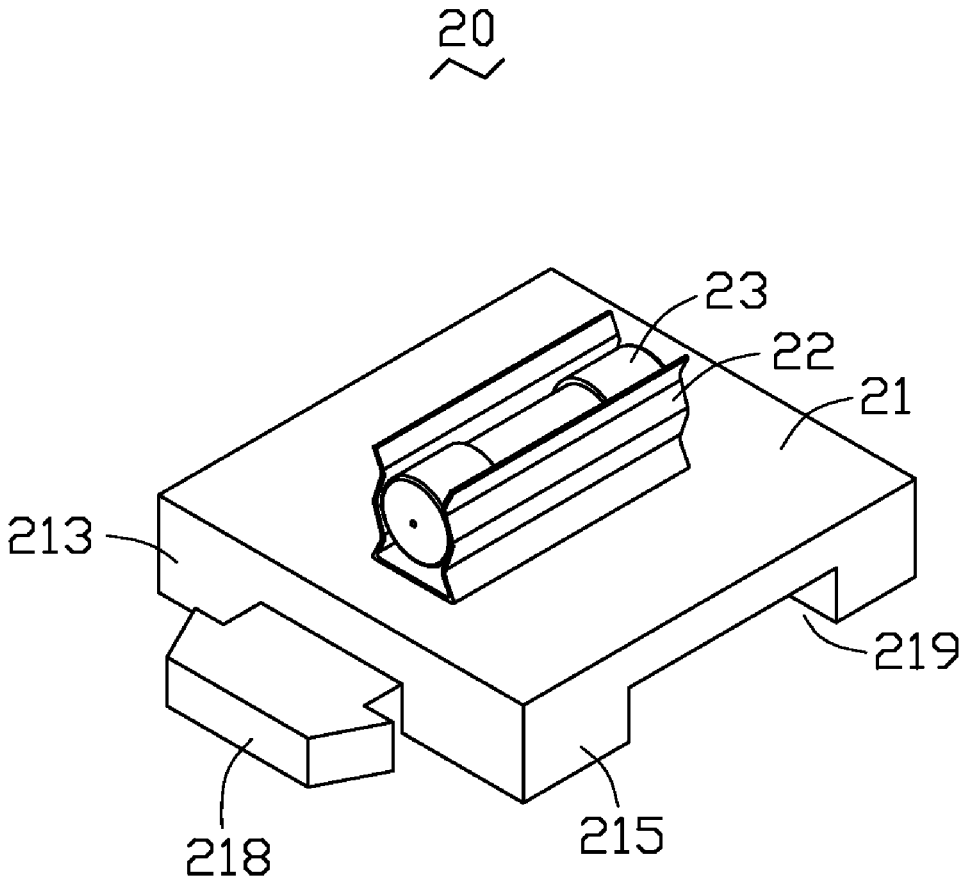
FIG. 6 is a perspective view of a light source module according to a second embodiment of the present invention.

Referring to FIG. 6, a light source module 20 according to a third embodiment is shown. The light source module 20 is similar to the light source module 10 of the first embodiment, except that the base 21 is substantially square, the protrusion 218 is formed on the first side surface 213, the recess 219 is defined in the third side surface 215 connected with the first side surface 213, only one supporter 22 is formed on the base 21, and each light source 23 is clamped by only one supporter 22.

Figure 7:
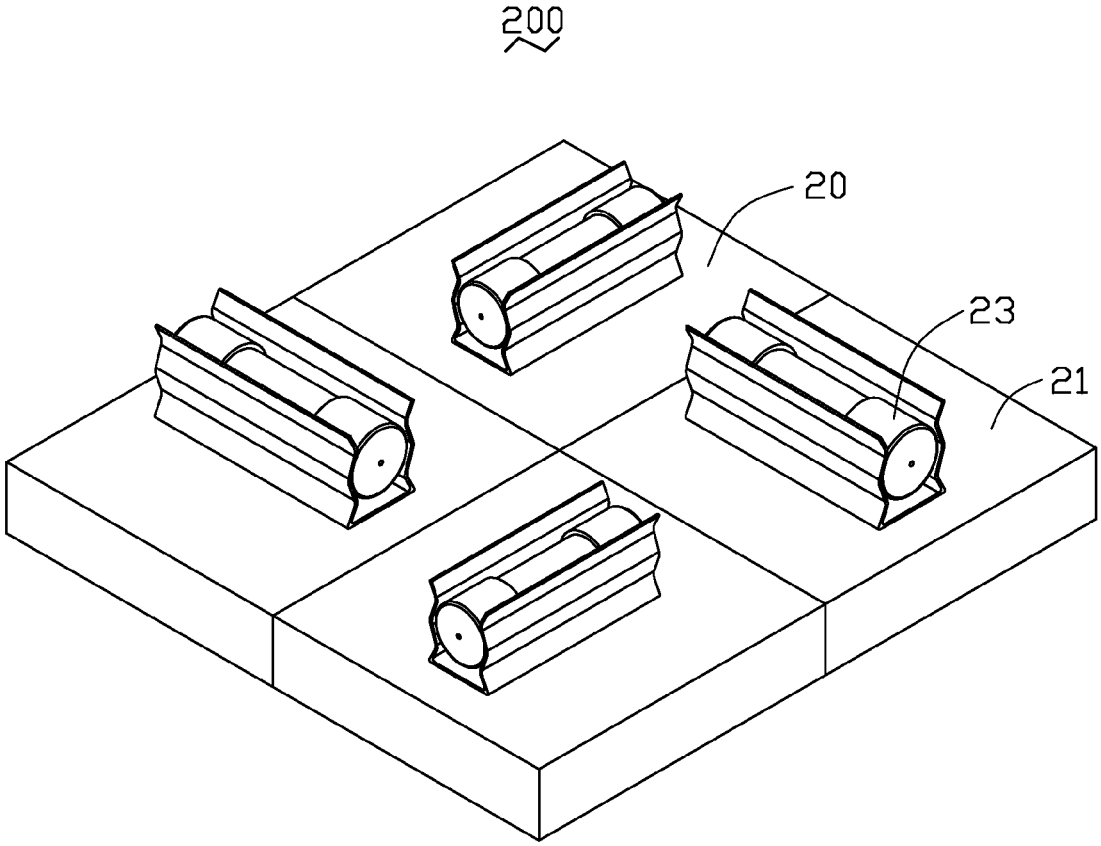
FIG. 7 is a perspective view of a light source module array according to a fourth embodiment of the present invention, having a plurality of light source modules of FIG. 6.
Figure 8:
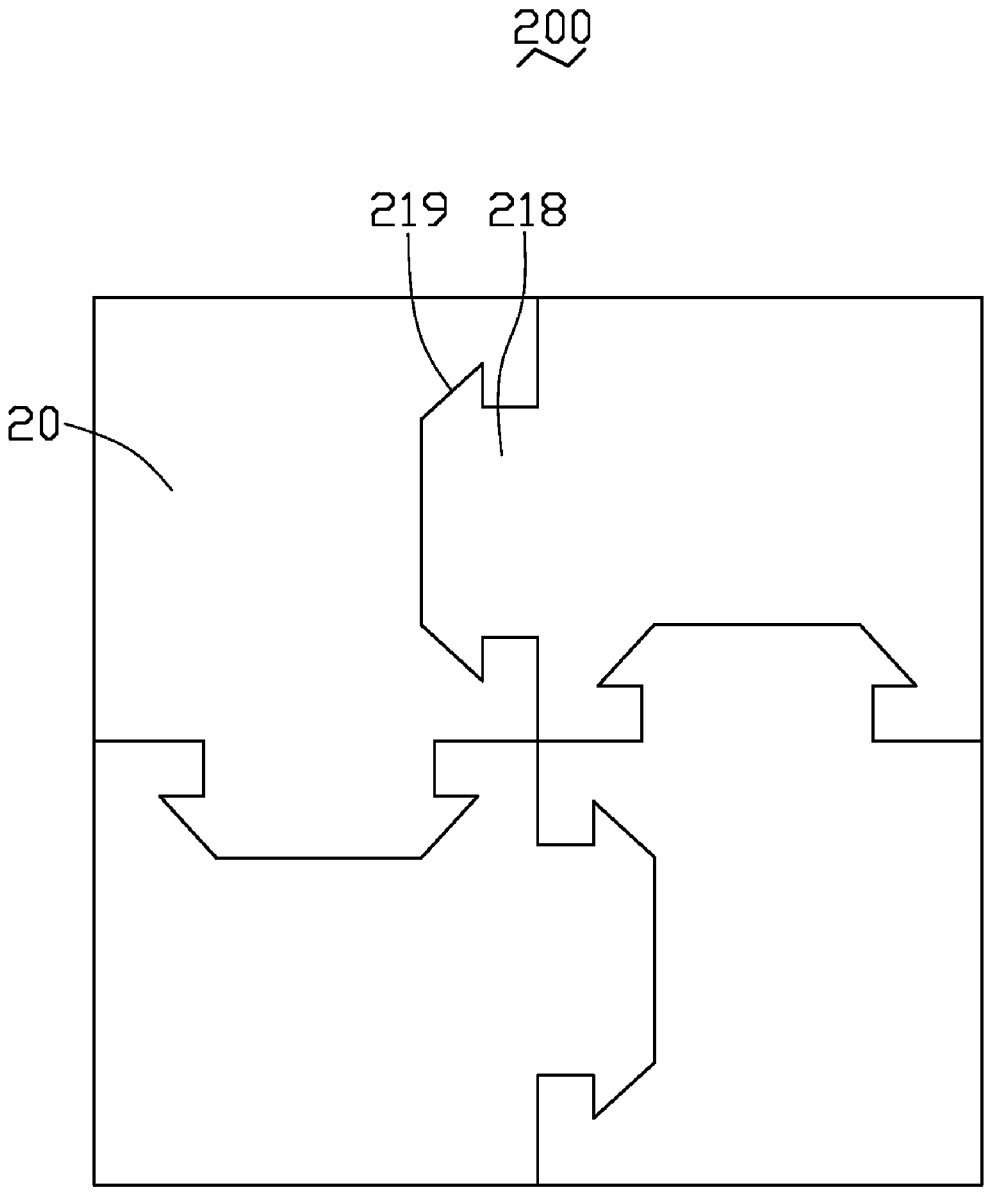
FIG. 8 is a plan view of the light source module array of FIG. 7.

Referring to FIGS. 7-8, a light source module array 200 in accordance with a fourth embodiment is shown. The light source module array 200 includes four light source module 20 of the third embodiment. The protrusion 218 of the light source module 20 is coupled to a recess 219 of an adjacent light source module 20. In the present embodiment, two adjacent light sources 23 are perpendicular to each other.

While certain embodiments have been described and exemplified above, various other embodiments from the foregoing disclosure will be apparent to those skilled in the art. The present invention is not limited to the particular embodiments described and exemplified but is capable of considerable variation and modification without departure from the scope of the appended claims.

What is claimed is:

1. A light source module comprising:

a base comprising a top surface, a first side surface connected with the top surface, a second side surface connected with the top surface, a protrusion projecting from the first side surface, and a recess defined in the second side surface, the protrusion being for inserting into a recess of another similar light source module, the recess being configured for coupling with a protrusion of still another similar light source module;

a supporter mounted on the top surface of the base; and a light source fixed by the supporter.

2. The light source module of claim 1, wherein the first side surface is opposite to the second surface.

3. The light source module of claim 1, wherein the first side surface is connected with the second surface.

4. The light source module of claim 1, wherein the supporter comprises two opposite fixing parts and a connecting part connected between the two fixing parts, and the light source is secured by the two fixing parts.

5. The light source module of claim 4, wherein each fixing part has a wave-shaped cross-section.

6. The light source module of claim 1, wherein the base further comprises a bottom surface opposite to the top surface, the protrusion comprises a first top surface and an opposite second bottom surface, and the second bottom surface is coplanar with the bottom surface of the base.

7. The light source module of claim 6, wherein the first top surface is parallel to the top surface of the base.

8. The light source module of claim 7, wherein the first top surface is positioned between the top and the bottom surfaces of the base.

9. A light source module array comprising a plurality of light source modules, each light source module comprising:

a base comprising a top surface, a first side surface connected with the top surface, a second side surface connected with the top surface, a protrusion protruding from the first side surface, and a recess defined in the second side surface, the protrusion inserted into a recess of another light source module, the recess receiving a protrusion of still another light source module;

a supporter mounted on the top surface of the base; and a light source fixed by the supporter.

10. The light source module array of claim 9, wherein the first side surface is opposite to the second surface.

11. The light source module array of claim 9, wherein the first side surface is connected with the second surface.

12. The light source module array of claim 9, wherein the supporter comprises two opposite fixing parts and a connecting part connected between the two fixing parts, and the light source is secured by the two fixing parts.

13. The light source module array of claim 12, wherein each fixing part has a wave-shaped cross-section.

14. The light source module array of claim 9, wherein the base further comprises a bottom surface opposite to the top surface, the protrusion comprises a first top surface and an opposite second bottom surface, and the second bottom surface is coplanar with the bottom surface of the base.

15. The light source module array of claim 14, wherein the first top surface is parallel to the top surface of the base.

16. The light source module array of claim 15, wherein the first top surface is positioned between the top and the bottom surfaces of the base.

17. The light source module array of claim 9, wherein the light source modules are arranged in a line.

18. The light source module array of claim 9, wherein two adjacent light source modules are perpendicular to each other.

* * * * *